US009004028B2

(12) United States Patent
Noguchi et al.

(10) Patent No.: US 9,004,028 B2
(45) Date of Patent: Apr. 14, 2015

(54) VALVE TIMING CONTROL APPARATUS

(75) Inventors: Yuji Noguchi, Obu (JP); Kazunari Adachi, Chiryu (JP); Atsushi Homma, Kariya (JP); Takeo Asahi, Kariya (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 38 days.

(21) Appl. No.: 13/821,394

(22) PCT Filed: Oct. 11, 2011

(86) PCT No.: PCT/JP2011/073313

§ 371 (c)(1), (2), (4) Date: Mar. 7, 2013

(87) PCT Pub. No.: WO2012/056874

PCT Pub. Date: May 3, 2012

(65) Prior Publication Data

US 2013/0167787 A1 Jul. 4, 2013

(30) Foreign Application Priority Data

Oct. 27, 2010 (JP) ..... 2010-240586

(51) Int. Cl.
*F01L 1/34* (2006.01)
*F01L 1/02* (2006.01)
*F01L 1/344* (2006.01)

(52) U.S. Cl.
CPC ..... *F01L 1/344* (2013.01); *F01L 1/3442* (2013.01); *F01L 2001/34483* (2013.01); *F01L 2101/00* (2013.01)

(58) Field of Classification Search
CPC ..... F01L 1/3442; F01L 1/344; F01L 1/34; F01L 2001/34426; F02D 2041/001
USPC ..... 123/90.17, 90.15, 90.31
See application file for complete search history.

(56) References Cited

U.S. PATENT DOCUMENTS 5,775,279 A * 7/1998 Ogawa et al. ..... 123/90.17
6,039,016 A * 3/2000 Noguchi ..... 123/90.17

(Continued)

FOREIGN PATENT DOCUMENTS

CN 1573029 A 2/2005
CN 101031703 A 9/2007

(Continued)

OTHER PUBLICATIONS

Machine generated English translation of JP 2002-161719 A.*

(Continued)

*Primary Examiner* — Thomas Denion
*Assistant Examiner* — Ngoc T Nguyen
(74) *Attorney, Agent, or Firm* — Buchanan Ingersoll & Rooney PC

(57) ABSTRACT

Even when sliding occurs between a radially extending face of a spring member and at least one of a driving-side rotary member and a driven-side rotary member, wear of the at least one of the driving-side rotary member and the driven-side rotary member is prevented. Along the axial direction of the camshaft, a torsion spring is provided between the driven-side rotary member and a housing side face portion for urging the relative rotational phase to the angle advancing direction or the angle retarding direction, and a spring washer is disposed between the driven-side rotary member and the torsion spring.

4 Claims, 4 Drawing Sheets

(56) References Cited

U.S. PATENT DOCUMENTS

| | | | | |
|---|---|---|---|---|
| 6,276,321 | B1 | 8/2001 | Lichti et al. | |
| 6,374,786 | B1 * | 4/2002 | Ogawa | 123/90.17 |
| 6,439,184 | B1 | 8/2002 | Takenaka et al. | |
| 7,165,521 | B2 | 1/2007 | Nakajima | |
| 7,222,598 | B2 | 5/2007 | Hayashi | |
| 7,571,700 | B2 * | 8/2009 | Ogawa et al. | 123/90.17 |
| 7,958,857 | B2 * | 6/2011 | Lichti et al. | 123/90.17 |
| 8,281,756 | B2 * | 10/2012 | Suzuki et al. | 123/90.17 |
| 8,689,747 | B2 * | 4/2014 | Kobayashi et al. | 123/90.17 |
| 8,776,742 | B2 * | 7/2014 | Sakane | 123/90.17 |
| 8,776,748 | B2 * | 7/2014 | Kobayashi et al. | 123/90.17 |
| 2002/0038640 | A1 | 4/2002 | Fujiwaki et al. | |
| 2002/0139330 | A1 | 10/2002 | Takahashi et al. | |
| 2004/0182342 | A1 | 9/2004 | Nakajima | |
| 2005/0016482 | A1 | 1/2005 | Kobayashi et al. | |
| 2005/0183682 | A1 | 8/2005 | Uozaki et al. | |
| 2007/0266970 | A1 | 11/2007 | Ogawa | |
| 2009/0078222 | A1 | 3/2009 | Murao et al. | |

FOREIGN PATENT DOCUMENTS

| | | | | |
|---|---|---|---|---|
| EP | 1 568 854 | A2 | 8/2005 | |
| JP | 2002-161719 | A | 6/2002 | |
| JP | 2002-295208 | A | 10/2002 | |
| JP | 2002-295210 | A | 10/2002 | |
| JP | 2004-204726 | A | 7/2004 | |
| JP | 2004-300930 | A | 10/2004 | |
| JP | 2006-183590 | A | 7/2006 | |
| JP | 2009-185766 | A | 8/2009 | |
| KR | 10-2009-0031268 | A | 3/2009 | |
| WO | WO2013099576 | * | 4/2013 | F01L 1/356 |

OTHER PUBLICATIONS

Notice of Allowance dated Feb. 25, 2014 issued by Korean Intellectual Property Office in corresponding Korean Application No. 2014-013508288 (2 pgs).

English language version of International Preliminary Examination Report (PCT/IPEA/409) issued May 2, 2013 by the Japanese Patent Office as International Examination Authority for International Application No. PCT/JP2011/073313.

Extended European Search Report dated Oct. 23, 2013, issued by the European Patent Office in corresponding European Patent Application No. 11836013.0-1606 / 2602446. (4 pages).

International Search Report (PCT/ISA/210) issued on Nov. 22, 2011, by the Japanese Patent Office as the International Searching Authority for International Application No. PCT/JP2011/073313.

Written Opinion (PCT/ISA/237) issued on Nov. 22, 2011, by the Japanese Patent Office as the International Searching Authority for International Application No. PCT/JP2011/073313.

International Preliminary Examination Report (PCT/IPEA/409) Issued Aug. 23, 2012 by the Japanese Patent Office as International Examination Authority for International Application No. PCT/JP2011/073313.

Office Action (Notification of the First Office Action) issued on Nov. 19, 2014, by the State Intellectual Property Office of P.R.C in corresponding Chinese Patent Application No. 201180043093.0, and an English Translation of the Office Action. (14 pages).

* cited by examiner

VALVE TIMING CONTROL APPARATUS

TECHNICAL FIELD

The present invention relates to a valve timing control apparatus for adjusting opening/closing timings of an intake valve and an exhaust valve of an internal combustion engine of an automobile or the like according to a driving condition.

BACKGROUND ART

A valve timing control apparatus is used in an internal combustion engine such as an engine for an automobile. The apparatus adjusts valve opening/closing timings for rendering the internal combustion engine into a favorable operational condition, by varying the relative rotational phase between a driving-side rotary member rotated in synchronism with a crankshaft and a driven-side rotary member disposed coaxial with the driving-side rotary member and rotated in synchronism with a camshaft.

A valve timing control apparatus disclosed in PTL 1 is provided with a spring member configured to urge the relative rotational phase to the angle advancing direction. More particularly, this spring member provides the urging to the angle advancing direction in order to offset a force acting to the angle retarding direction that occurs in association with a torque variation of a cam mounted on the camshaft.

On the other hand, with the valve timing control apparatuses disclosed in PTL 1 and PTL 2, aluminum is employed as the material for forming the driving-side rotary member and the driven-side rotary member instead of the conventionally employed cast-iron type material or the like. In general, as aluminum is light-weight compared with the cast-iron type material, aluminum is suitable for use in an automobile for which weight reduction is sought for.

CITATION LIST

Patent Literature

PTL 1: Japanese Unexamined Patent Application Publication No. 2002-295208

PTL 2: Japanese Unexamined Patent Application Publication No. 2006-183590

SUMMARY OF INVENTION

Technical Problem

At the time of varying the relative rotational phase, there occurs a change in the dimension of the spring member in the radial direction. In association with this change in the radial dimension of the spring member, there occurs a sliding displacement between the radially extending face of the spring member and at least one of the driving-side rotary member and the driven-side rotary member. However, in case a soft material such as aluminum is employed as the material forming the driving-side rotary member and the driven-side rotary member as is the case with PTL 1 and PTL 2, there occurs the problem of wear in at least one of the driving-side rotary member and the driven-side rotary member in association with such change in the radial dimension of the spring member.

The present invention has been made in view of the above-described state of the art. The object of the invention is to provide a valve timing control apparatus with which it is possible to restrict such wear of the driving-side rotary member and the driven-side rotary member even when a sliding displacement occurs between the radially extending face of the spring member and at least one of the driving-side rotary member and the driven-side rotary member.

Solution to Problem

According to a first characterizing feature provided by the present invention for achieving the above-noted technical object, a valve timing control apparatus comprises:

a driving-side rotary member rotated in synchronism with a crankshaft of an internal combustion engine;

a driven-side rotary member disposed coaxial with the driving-side rotary member and rotated in synchronism with a valve opening/closing camshaft of the internal combustion engine; and a retard angle chamber and an advance angle chamber formed by the driving-side rotary member and the driven-side rotary member, the retard angle chamber being configured to move a relative rotational phase of the driven-side rotary member relative to the driving-side rotary member to an angle retarding direction, the advance angle chamber being configured to move the relative rotational phase to an angle advancing direction, respectively, in response to feeding of a work oil respectively thereto;

wherein the driving-side rotary member includes a housing main body portion disposed on the radial outer side of the driven-side rotary member and at least two housing side face portions, each housing side face portion being provided at an end of the housing main body portion corresponding thereto along the axial direction of the camshaft and slidable relative to the driven-side rotary member; and a spring member disposed between the driven-side rotary member and the housing side face portion along the axial direction of the camshaft, the spring member urging the relative rotational phase to the angle advancing direction or the angle retarding direction; and a spring washer disposed between the driven-side rotary member and the spring member;

wherein the spring washer includes a hook portion which extends along the axial direction of the camshaft; and one end of the spring member is engaged with the driven-side rotary member via the hook portion.

With the above-described arrangement, since a spring washer is disposed between the driven-side rotary member and the spring member along the axial direction of the camshaft, occurrence of wear of the driven-side rotary member in association with change in the radial dimension of the spring member can be effectively restricted. Further, since a hook portion is formed in the spring washer, rotational displacement of the spring washer can be restricted advantageously. Moreover, since one end of the spring member is engaged with the driven-side rotary member via the hook portion, no direct contact occurs between the spring member and the driven-side rotary member. Therefore, wear of the driven-side rotary member by the spring member can be restricted advantageously.

According to a second characterizing feature provided by the present invention, the spring washer includes a washer portion for a fastening member for fastening the camshaft with the driven-side rotary member.

With the above-described arrangement, the spring washer includes a washer portion for a fastening member. Hence, as compared with the case of using two washers, the axial length of the camshaft of the valve timing control apparatus can be reduced advantageously. Further, since the single member, i.e. the spring washer, acts not only as a washer for the spring member, but as a washer for the fastening member, increase in the number of components can be restricted advantageously.

According to a third characterizing feature provided by the present invention, the spring washer includes a guide portion for maintaining the posture of the spring member.

With the above-described arrangement, since the posture of the spring member can be maintained by the guide portion, it is possible to allow the urging force of the spring member to act on the driven-side rotary member in a stable manner.

According to a fourth characterizing feature provided by the present invention, the driven-side rotary member is formed of aluminum and the spring washer is formed of a material having a higher strength than aluminum.

With the above-described arrangement, even if soft aluminum is employed as the material for forming the driven-side rotary member, wear of the driven-side rotary member in association with change in the radial dimension of the spring member can be restricted by the spring washer formed of a material having higher strength than aluminum.

According to a fifth characterizing feature provided by the present invention, the spring member is set under a compressed state compressed from its free length to a predetermined length, so as to press the housing side face portion on the side opposite the side where the camshaft is provided.

With the above-described arrangement, as the spring member is set under a compressed state compressed from its free length to a predetermined length, the driven-side rotary member and the housing side face portion on the side opposite the side where the camshaft is provided are pressed to sides away from each other along the axial direction of the camshaft.

Normally, the driving-side rotary member is pivotally supported and has its axis fixedly determined by the camshaft or the driven-side rotary member rotatable in synchronism with the camshaft. In this way, as the urging force of the spring member is directed to the axial direction of the camshaft to act on the housing side face portion on the side opposite the camshaft, the housing side face portion on the side opposite the camshaft can be pivotally supported by the pressing force provided by the spring member, even if being not pivotally supported by the camshaft or the driven-side rotary member.

DESCRIPTION OF EMBODIMENTS

A valve timing control apparatus relating to the present invention will be described with reference to the accompanying drawings by way of an embodiment shown therein wherein the apparatus is applied as an intake valve side or an exhaust valve side valve timing control apparatus of an automobile.

Figure 1:
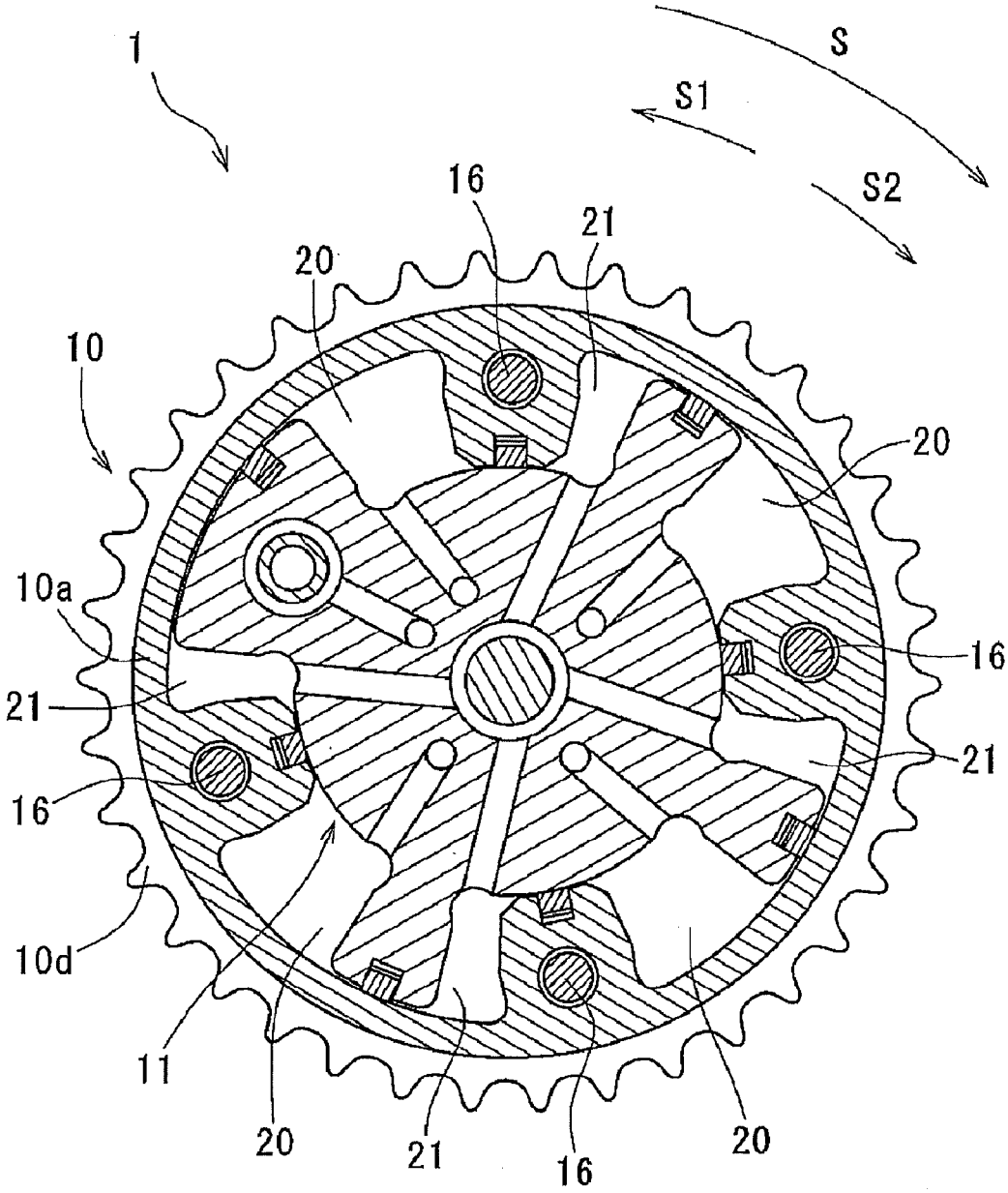
FIG. 1 is a front view in section showing a valve timing control apparatus according to an embodiment.
Figure 2:
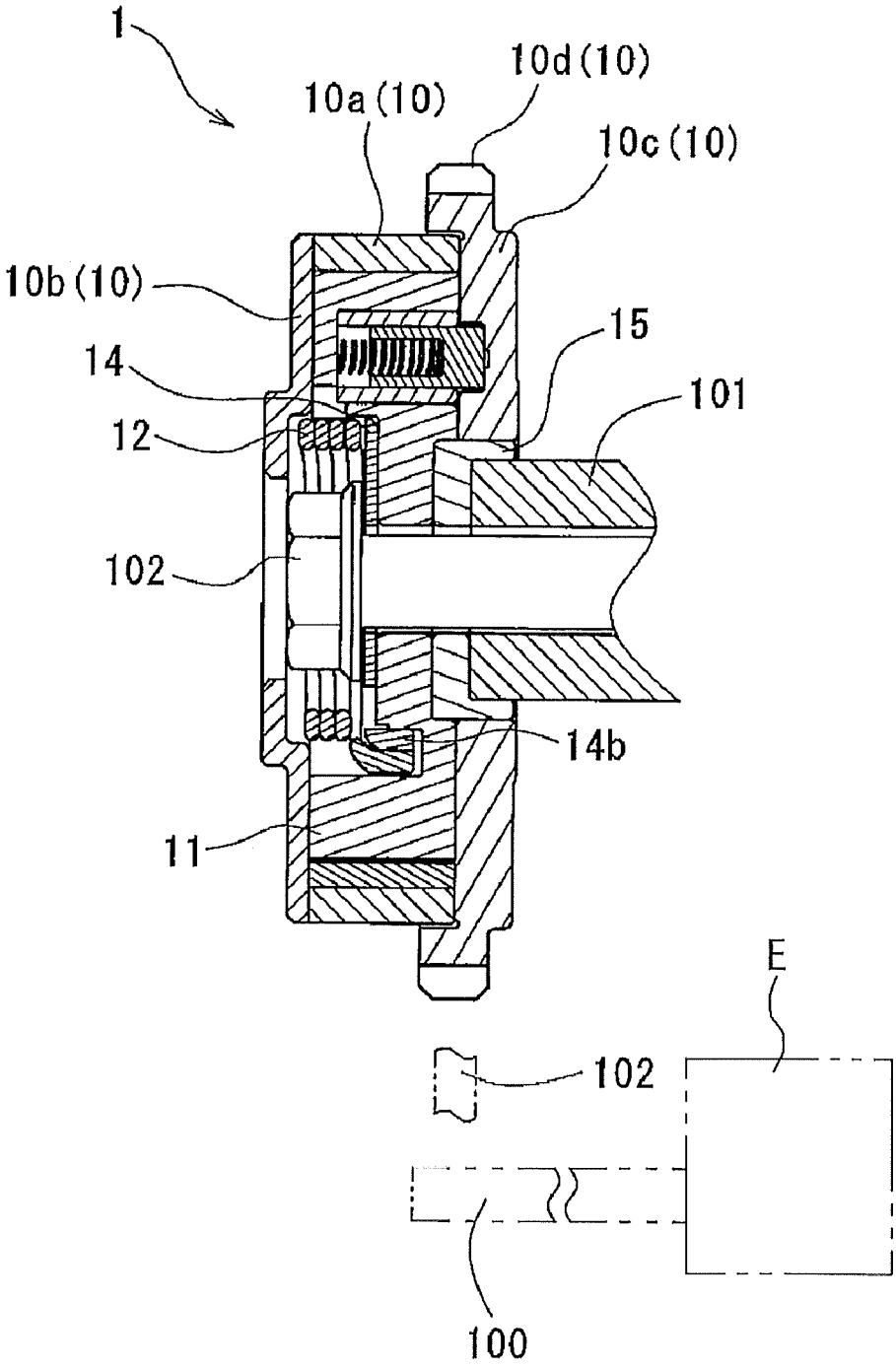
FIG. 2 is a side view in section showing the valve timing control apparatus according to the embodiment.
Figure 3:
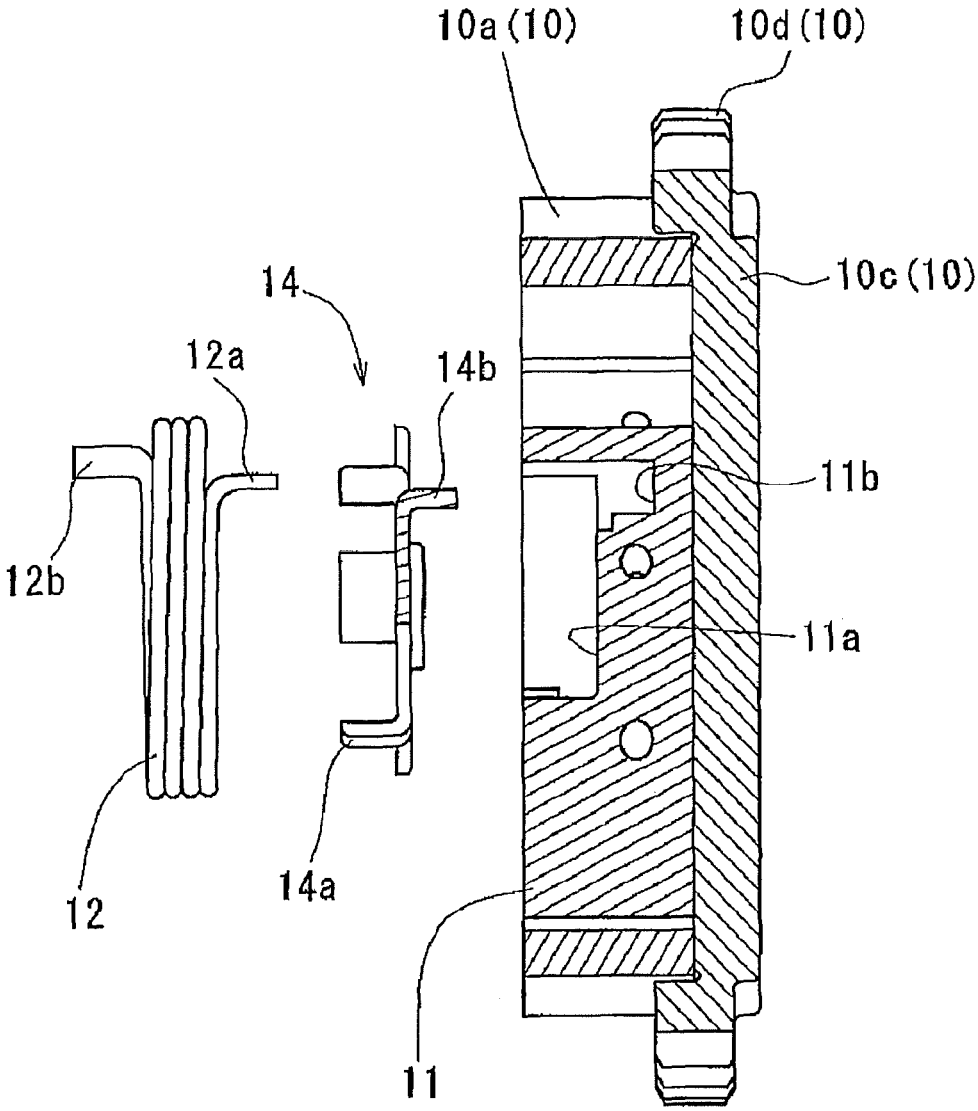
FIG. 3 is a side view in section showing the valve timing control apparatus according to the embodiment.

FIG. 1 and FIG. 3 show a valve timing control apparatus 1 according to the instant embodiment. The valve timing control apparatus 1 includes a driving-side rotary member 10 driven to rotate in synchronism with a crankshaft 100 of an internal combustion engine E and a driven-side rotary member 11 disposed coaxially with the driving-side rotary member 10 and driven to rotate in synchronism with a valve opening/closing camshaft 101 of the internal combustion engine E. The valve timing control apparatus 1 further includes a retard angle chamber 20 and an advance angle chamber 21 formed by the driving-side rotary member 10 and the driven-side rotary member 11, the retard angle chamber 20 being configured to move a relative rotational phase of the driven-side rotary member 11 relative to the driving-side rotary member 10 to an angle retarding direction S1, the advance angle chamber 21 being configured to move the relative rotational phase to an angle advancing direction S2, respectively, in response to feeding of a work oil respectively thereto. As shown in FIG. 2, the driving-side rotary member 10 is comprised of a housing main body portion 10*a* disposed on the radial outer side of the driven-side rotary member 11 and a pair of housing side face portions 10*b*, 10*c* disposed on the opposed sides of the housing main body portion 10*a* along the axial direction of the camshaft 101 and slidable relative to the driven-side rotary member 11. Along the axial direction of the camshaft 101, between the driven-side rotary member 11 and the housing side face portions 10*b*, 10*c*, there is provided a torsion spring 12 for urging the relative rotational phase to the angle retarding direction S1 or the angle advancing direction S2, and between the driven-side rotary member 11 and the torsion spring 12, there is provided a spring washer 14.

The driving-side rotary member 10 is comprised of the housing main body portion 10*a* disposed on the radial outer side of the driven-side rotary member 11, the housing side face portion 10*b* disposed on the side opposite the camshaft 101 across the housing main body portion 10*a* and the housing side face portion 10*c* disposed on the side closer to the camshaft 101 than the housing main body portion 10*a*. The housing side face portion 10*c* is pivotally supported by the camshaft 101 via a bearing member 15. Further, the housing main body portion 10*a* is pivotally supported by the driven-side rotary member 11. Also, the housing side face portion 10*b* is configured so as not to be displaced from the axis of the driven-side rotary member 11 by the pressing force provided from the torsion spring 12 described later and acting to the axial direction of the cam shaft 101. On the other hand, the housing main body portion 10*a* and the housing side face portions 10*b*, 10*c* are fastened together with four bolts 16, thus together constituting the driving-side rotary member 10. Hence, the housing side face portion 10*b* is set under a compressed state by the pressing force of the torsion spring 12 and the fastening forces of the bolts 16. Accordingly, in the valve timing control apparatus according to the present embodiment, as the driven-side rotary member 11 does not provide direct pivotal support for the housing side face portion 10*b*, the axial length of the camshaft 101 can be reduced. Advantageously, the driving-side rotary member 10 can be formed of a metal such as aluminum which is light-weight and can be easily worked.

Along the outer circumference of the housing side face portion 10*c*, a timing sprocket 10*d* is formed. Between this timing sprocket 10*d* and the crankshaft 100, there is mounted a force transmission member 102 such as a timing chain, a timing belt, etc. In operation, when the internal combustion engine E is driven, the crankshaft 100 is rotated to rotate the timing sprocket 10*d* via the force transmission member 102. And, in association with this rotation of the timing sprocket 10*d*, the valve timing control apparatus 1 revolves in a rotational direction S.

The driven-side rotary member 11 is mounted on the radially inner side of the housing main body portion 10*a*. Based on the function of work oil in the retard angle chamber 20 and the advance angle chamber 21, the relative rotational phase of the driven-side rotary member 11 relative to the driving-side rotary member 10 is varied and the driven-side rotary member 11 is rotated in synchronism with the driving-side rotary member 10. Further, the driven-side rotary member 11 is fastened to the camshaft 101 by a cam bolt 102, so that the driven-side rotary member 11 and the camshaft 101 are rotated in synchronism. Advantageously, the driven-side rotary member 11 can be formed of a metal such as aluminum which is light-weight and can be easily worked.

Incidentally, the work oil to the retard angle chamber 20 and the advance angle chamber 21 is discharged from an unillustrated oil pump and fed thereto after its supply amount control by an unillustrated oil control valve. This oil control valve controls also discharging of the work oil from the retard angle chamber 20 and the advance angle chamber 21 to an unillustrated oil pan.

As shown in FIG. 3, on the radially inner side of the driven-side rotary member 11, there is formed an accommodating portion 11*a* for accommodating the torsion spring 12 and the spring washer 14 which will be detailed later. The accommodating porton 11*a* has a bottomed circular hole shape opened on the side of the housing side face portion 10*b*. Further, in the accommodating portion 11*a*, there is formed an engaged portion 11*b* in the form of a groove cutaway by one step lower toward the housing side face portion 10*c* than the bottom portion of the accommodating portion 11*a*. The engaged portion 11*b* comes into engagement with a hook portion 14*b* of the spring washer 14 to be described later.

In the accommodating portion 11*a*, the torsion spring 12 is mounted. This torsion spring 12 comprises a length of elongate metal wire coiled in the spiral form, with one end 12*a* and the other end 12*b* of the wire being bent to be aligned with the axial direction of the camshaft 101. With this torsion spring 12, the one end 12*a* thereof engages with the driven-side rotary member 11 via the hook portion 14*b* of the spring washer 14 to be described later and the other end 12*b* thereof engages with the housing side face portion 10*b*. And, the torsion spring 12 urges the relative rotational phase of the driven-side rotary member 11 relative to the driving-side rotary member 10 to the angle advancing direction S2. Further, this torsion spring 12 is set under a compressed state compressed from its free length to a predetermined reduced length, thereby to press the housing side face portion 11*b* opposite the camshaft 101 away from this camshaft 101.

Figure 4:
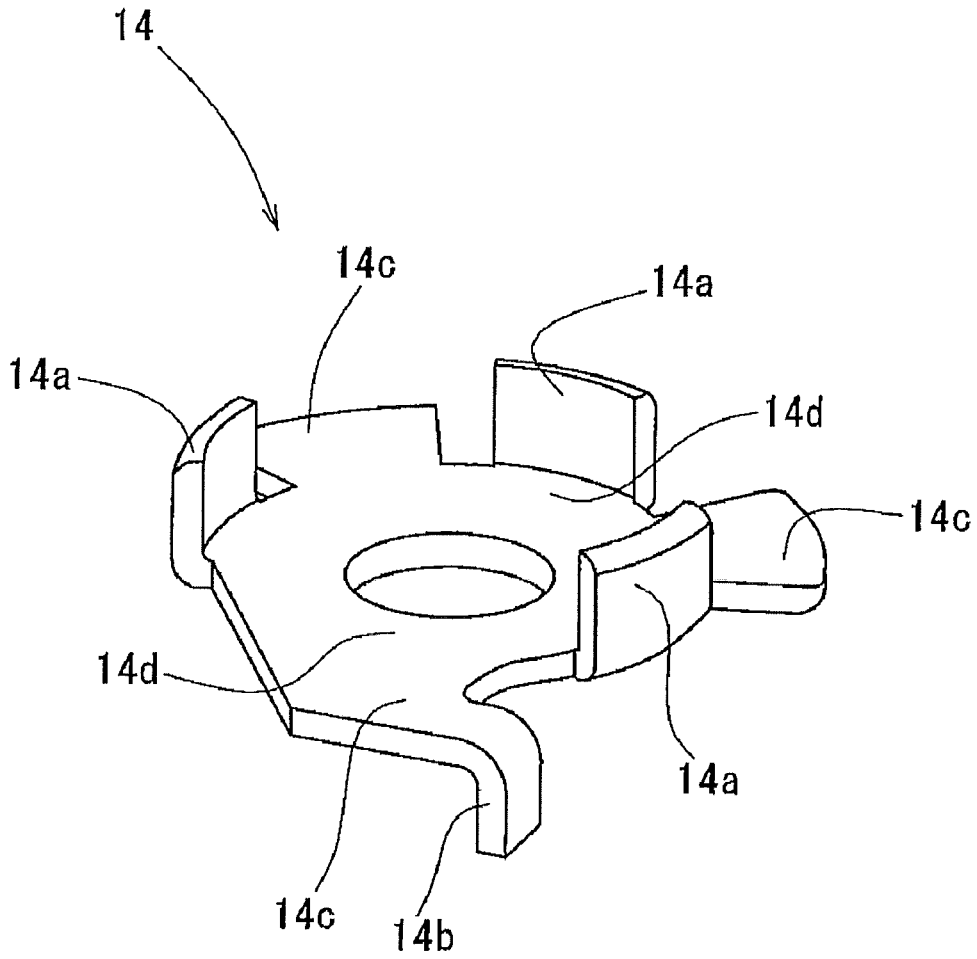
FIG. 4 is a perspective view showing only a spring washer according to the embodiment.

In the accommodating portion 11*a*, in other words, between the driven-side rotary member 11 and the torsion spring 12 along the axial direction of the camshaft 101, the spring washer 14 is provided. FIG. 4 shows a perspective view of this spring washer 14. The spring washer 14 includes a guide portion 14*a* for preventing deformation to the inner radius side beyond a predetermined diameter when the torsion spring 12 urges the relative rotational phase to the angle advancing direction S2, and the hook portion 14*b* that engages with the driven-side rotary member 11 and extends toward the axial direction of the camshaft 101 in order to prevent the one end 12*a* of the torsion spring 12 from coming into direct contact with the driven-side rotary member 11. The spring washer 14 further includes a spring washer portion 14*c* for preventing direct contact between the radially extending face of the torsion spring 12 and the driven-side rotary member 11, and a cam bolt washer portion 14*d* for the cam bolt 102. Advantageously, the spring washer 14 can be formed of a material having a higher strength than the driven-side rotary member 11. Also, the spring washer 14 can be readily formed by execution of a press work on metal in the form of a flat plate.

As described above, with the valve timing control apparatus 1 according to the instant embodiment, even when a soft material such as aluminum is employed as the material for forming the driven-side rotary member 11, since the spring washer 14 is interposed between the driven-side rotary member 11 and the torsion spring 12, wear of the driven-side rotary member 11 in association with change in the radial dimension of the torsion spring 12 can be restricted by the spring washer portion 14*c* advantageously.

Incidentally, in the foregoing embodiment, as the spring washer 14, there was disclosed an example thereof in which it includes the hook portion 14*b* that extends along the axial direction of the camshaft 101 in order to prevent the one end 12*a* of the torsion spring 12 from coming into direct contact with the driven-side rotary member 11. However, the invention is not limited thereto. For instance, the spring washer 14 can include a hook portion that extends along the axial direction of the camshaft 101 in order to prevent the other end 12*b* of the torsion spring 12 from coming into direct contact with the housing side face portion 10*b*. In this case, advantageously, the guide portion 14*a* of the spring washer 14 can be formed to extend further toward the housing side face portion 10*b* along the axial direction of the camshaft 101.

Further, in the foregoing embodiment, the torsion spring 12 was configured to urge the relative rotational phase to the angle advancing direction S2. Instead, the torsion spring can be configured to urge the relative rotational phase to the angle retarding direction S1. In the case of using such torsion spring configured to urge the phase to the angle retarding direction S1, with a valve timing control apparatus having a lock mechanism for locking the relative rotational phase to the most retarded angle phase, the lock mechanism can provide even more reliable locking function.

INDUSTRIAL APPLICABILITY

The present invention can be applied to a valve timing control apparatus wherein even when sliding occurs between a surface that extends along the radial direction of a spring member and at least one of a driving-side rotary member and a driven-side rotary member, wear of the at least one of the driving-side rotary member and the driven-side rotary member can be prevented.

REFERENCE SIGNS LIST

1 valve timing control apparatus
10 driving-side rotary member
10*a* housing main body portion (driving-side rotary member)
10*b*, 10*c* housing side face portions (driving-side rotary member)
11 driven-side rotary member
12 torsion spring (spring member)
14 spring washer
14*a* guide portion
14*b* hook portion
14*c* spring washer portion
14*d* cam bolt washer portion (fastening member washer portion)
20 retard angle chamber
21 advance angle chamber
100 crankshaft
101 camshaft
102 cam bolt (fastening member)

The invention claimed is:

1. A valve timing control apparatus comprising:

a driving-side rotary member rotated in synchronism with a crankshaft of an internal combustion engine;

a driven-side rotary member disposed coaxial with the driving-side rotary member and rotated in synchronism with a valve opening/closing camshaft of the internal combustion engine;

a retard angle chamber and an advance angle chamber formed by the driving-side rotary member and the driven-side rotary member, the retard angle chamber being configured to move a relative rotational phase of the driven-side rotary member relative to the driving-side rotary member to an angle retarding direction, the advance angle chamber being configured to move the relative rotational phase to an angle advancing direction, respectively, in response to feeding of a work oil respectively thereto;

wherein the driving-side rotary member includes a housing main body portion disposed on the radial outer side of the driven-side rotary member and at least two housing side face portions, each housing side face portion being provided at an end of the housing main body portion corresponding thereto along the axial direction of the camshaft and slidable relative to the driven-side rotary member;

a spring member disposed between the driven-side rotary member and one of the at least two housing side face portions along the axial direction of the camshaft, the spring member urging the relative rotational phase to the angle advancing direction or the angle retarding direction;

a spring washer disposed between the driven-side rotary member and the spring member;

wherein the spring washer includes a hook portion which extends along the axial direction of the camshaft;

one end of the spring member is engaged with the driven-side rotary member via the hook portion; and the spring washer includes a guide portion for maintaining the posture of the spring member.

2. The valve timing control apparatus according to claim 1, wherein the spring washer includes a washer portion for a fastening member for fastening the camshaft with the driven-side rotary member.

3. The valve timing control apparatus according to claim 1, wherein the driven-side rotary member is formed of aluminum.

4. The valve timing control apparatus according to claim 1, wherein the spring member is set under a compressed state compressed from its free length to a predetermined length, so as to press the one of the at least two housing side face portions on a side opposite to a side where the camshaft is provided.

* * * * *